US006270108B1

(12) United States Patent
Phelipon et al.

(10) Patent No.: US 6,270,108 B1
(45) **Date of Patent: *Aug. 7, 2001**

(54) DEVICE FOR DAMPING VIBRATIONS OF A SKI

(75) Inventors: Axel Phelipon, Annecy; Jacques Le Masson, Cran Gevrier, both of (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/976,573

(22) Filed: Nov. 24, 1997

Related U.S. Application Data

(63) Continuation of application No. 08/121,457, filed on Sep. 16, 1993, now abandoned, which is a continuation of application No. 07/871,920, filed on Apr. 22, 1992, now abandoned.

(30) Foreign Application Priority Data

Apr. 22, 1991 (FR) ..... 91 05421

(51) Int. Cl.[7] ..... A63C 5/07
(52) U.S. Cl. ..... 280/602; 280/607
(58) Field of Search ..... 280/11.14, 602, 280/607, 609, 610, 617, 633, 636

(56) References Cited

U.S. PATENT DOCUMENTS

| | | | | |
|---|---|---|---|---|
| 2,539,224 | * | 1/1951 | Beerli | 280/602 |
| 2,661,219 | * | 12/1953 | Coulson, Jr. | 280/602 |
| 3,260,531 | * | 7/1966 | Heuvel | 280/602 |
| 3,260,532 | * | 7/1966 | Heuvel | 280/602 |
| 3,797,844 | * | 3/1974 | Smolka | 280/11.14 |
| 4,139,214 | * | 2/1979 | Meyer | 280/607 |
| 4,537,417 | * | 8/1985 | Hirnbock et al. | 280/602 |
| 4,592,567 | * | 6/1986 | Sartor | 280/602 |
| 4,740,009 | * | 4/1988 | Hoelzl | 280/602 |
| 4,804,200 | * | 2/1989 | Kuchler | 280/602 |
| 4,865,345 | * | 9/1989 | Piegay | 280/602 |
| 4,896,895 | * | 1/1990 | Bettosini | 280/607 |
| 4,974,867 | * | 12/1990 | Ruillier et al. | 280/607 |
| 5,092,618 | * | 3/1992 | Mayr | 280/602 |
| 5,251,923 | * | 10/1993 | Stepanek et al. | 280/602 |
| 5,284,357 | * | 2/1994 | Tinkler | 280/602 |
| 5,332,252 | * | 7/1994 | Le Masson et al. | 280/602 |
| 5,417,448 | * | 5/1995 | Le Masson et al. | 280/602 |

FOREIGN PATENT DOCUMENTS

| | | | | |
|---|---|---|---|---|
| 3315638 | * | 12/1983 | (DE) | 280/602 |
| 376 890 | | 10/1985 | (DE) . | |
| 3505255 | * | 8/1986 | (DE) | 280/602 |
| 3933717 | * | 4/1990 | (DE) | 280/602 |
| 4020212 | * | 1/1991 | (DE) | 280/602 |
| 73456 | * | 4/1948 | (NO) | 280/602 |
| 8801189 | * | 2/1988 | (WO) | 280/602 |

* cited by examiner

*Primary Examiner*—Robert P. Olszewski
*Assistant Examiner*—Andrew J. Fischer
(74) *Attorney, Agent, or Firm*—Greenblum & Bernstein, P.L.C.

(57) ABSTRACT

Device for damping ski vibrations constituted by at least one flexible strip rigidly attached to the ski and at least one flexible connection piece, the rigid attachment being spaced longitudinally apart from the flexible connection piece.

12 Claims, 11 Drawing Sheets

AR
AV

D

DEVICE FOR DAMPING VIBRATIONS OF A SKI

This application is a file wrapper continuation of U.S. patent application Ser. No. 08/121,457, filed Sep. 16, 1993 now abandoned, which was a file wrapper continuation application of U.S. application Ser. No. 07/871,920 filed Apr. 22, 1992 Abn.

FIELD OF THE INVENTION

The present invention relates to a ski, such as an alpine, cross-country, or monoski, or a ski for snow surfing. More specifically, it concerns an improved version of these types of skis.

BACKGROUND OF THE INVENTION

Ski bodies are conventionally manufactured using a more or less flexible structure.

Various types of skis are currently known, and a very large number of variants exist. These skis are formed using an elongated beam whose front end curves upward so as to constitute a tip; similarly, the rear end is slightly curved so as to create the heel.

Present-day skis normally possess a composite structure in which different materials are combined in such a way that each comes optimally into play, in consideration of the distribution of mechanical stresses when the ski is being used. Thus, the structure generally comprises peripheral protective elements, interior resistance elements which withstand flection and torsion stresses, and a core. These elements are assembled by bonding or injection and assembly takes place under heat in a mold incorporating the final shape of the ski, which a comprises a sharply-raised front part forming a tip, a slightly-raised rear part forming a heel, and a central arched part.

Despite the concern of the manufacturers to make high-quality skis, ski makers have, to date, not produced a high-performance ski which proves satisfactory under all conditions of use.

Present-day skis exhibit a number of disadvantages, in particular poor performance during oscillations caused by vibrations or ski flexion. In fact, persistent vibrations cause a loss of gripping action and thus, poor ski behavior. It thus becomes important to damp vibrations, and solutions have been proposed. We indicate, for example, the solutions offered in French Patent Applications Nos. 2 503 569 and 2 575 393. However, these damping devices actually produce only slight effects of which the skier is unaware.

SUMMARY OF THE INVENTION

The present invention is designed to solve the various above-mentioned difficulties and proposes an especially simple, effective, and reliable solution of problems of vibration damping.

Accordingly, the device according to the invention designed to damp the vibrations of a ski is formed by at least one flexible strip connected to the ski using a rigid connection means and at least one flexible means, these means being spaced apart longitudinally on this strip.

According to complementary features, the flexible strip comprises, mounted on at least one of its ends, a flexible connection means and, on the other of its ends, a rigid connection means.

According to a special arrangement, the flexible strip is a strip made of aluminum or a composite material.

The invention also concerns a ski equipped with a device according to the invention.

According to specific arrangements, the flexible strip is fastened to the upper surface of the ski or attached within its structure.

BRIEF DESCRIPTION OF THE DRAWINGS

Other features and advantages of the invention will emerge by virtue of the following description provided with reference to the attached drawings supplied solely as examples, and in which:

FIG. 1 is a side view.

FIG. 2 is a top view.

FIG. 3 is a transverse cross-section along line 3—3 in FIG. 2.

FIG. 4 is a transverse cross-section along line 4—4 in FIG. 2.

FIG. 5 is a partial, exploded perspective view.

FIG. 9 illustrates the ski in the resting, unflexed position.

FIG. 9*a* is an enlarged view of detail in FIG. 9.

FIG. 10 illustrates the ski in the flexed position.

FIG. 10*a* is an enlarged view of detail in FIG. 10.

DESCRIPTION OF THE PREFERRED EMBODIMENT

Figures 1, 2, 3, 4:
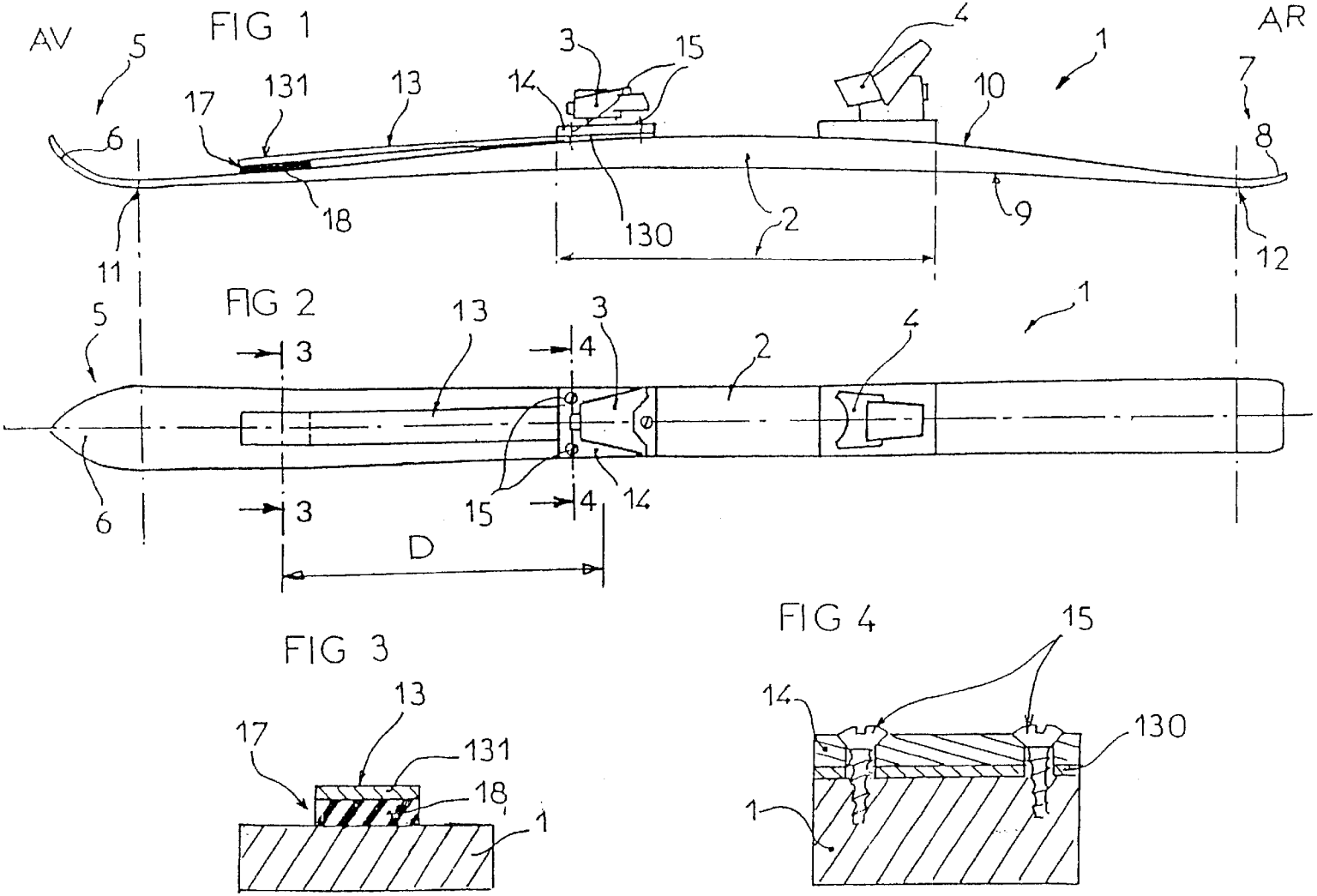
FIGS. 1 to 5 represent a first embodiment of the invention.
Figure 5:
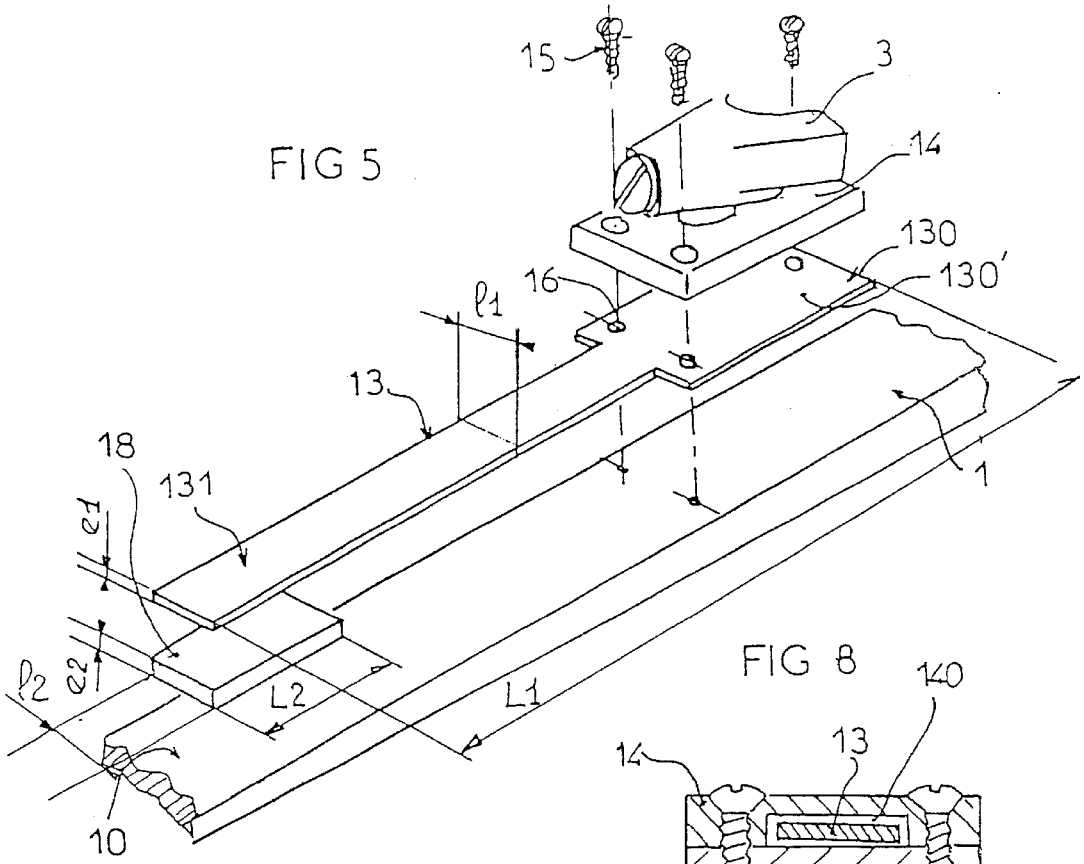
Figure 8:
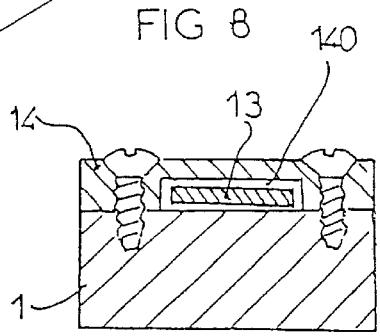
FIG. 8 is a cross-section along line 8—8 in the variant in FIG. 7.

The ski comprising the device is formed by an elongated beam with its own thickness and width distribution, and thus its own stiffness. It comprises a central part 2, also termed the area for mounting of the bindings 3,4 designed to hold the boot in place on the ski, the front binding 3 being commonly called a stop, while the rear binding 4 is normally called the heel piece. The front end 5 of the ski 1 is raised so as to form the tip 6, while, similarly, the rear end 7 is raised so as to form the heel 8 of the ski. The beam further comprises a lower sliding surface 9 and an upper surface 10. It should be noted that contact between the lower surface 9 and the snow occurs between the front point of contact 11 and the rear point of contact 12, which correspond to the locations where this lower surface begins to be combered.

According to the embodiments illustrated in FIGS. 1 to 25, the vibration-damping device according to the invention is constituted by a flexible strip 13, 13*a*, 13*b* positioned on the upper surface 10 of the ski and exterior to its actual structure.

According to a feature of the invention, the strip is attached to the ski using rigid connection means 15, 150 and at least some flexible connection means 17, 18, 180 spaced longitudinally apart from the rigid connection means 15, 150.

FIGS. 1 to 10 illustrate a first embodiment, according to which the vibration-damping device is such that the rear end 130 of the flexible strip 13 is attached to the ski in the central area 2 and extends forward (AV). This flexible strip 13 is for example, an aluminum strip having a thickness $e_1$ of between 1 and 5 millimeters, a width $l_1$ of between 10 and 60 millimeters, and a length (L1) of between 100 and 1200 millimeters. Its rear extremity 130 is rigidly attached to the ski in the area of the stop 3 using rigid connection means. Accordingly, the rear extremity 130 of the aluminum strip is arranged, for example, beneath the base plate 14 of the binding 3 and is held in place with this base plate by screws 15. To this end, the end 130 of the strip comprises an enlarged part 130' containing holes 16 allowing passage of the binding screws 15. According to the invention, the front end 131 of the flexible strip 13 is attached to the upper surface of the ski using vibration-damping means 17 constituting flexible connection means. Therefore, an interface 18 formed by a layer of a flexible, elastic material, in particular a viscoelastic material, is interposed between the front end 131 of the flexible strip 13 and the ski. This layer, whose thickness $e_2$ is between 0.5 and 4 millimeters, is glued or welded both, beneath the lower surface of the strip and on the upper surface of the ski 1. It may have a width $l_2$ identical with width $l_1$ of the strip, and a length $L_2$ of between 2 and 15 centimeters. It will be noted that the rigid connection means 15 are spaced longitudinally apart by a distance D from the flexible connection means 17.

Figure 6:
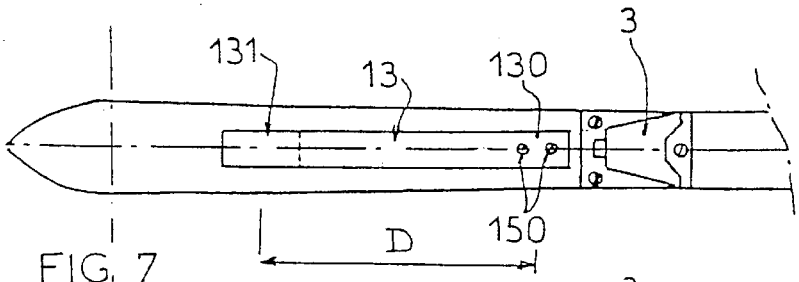
FIG. 6 and 7 are top views illustrating two variants.
Figure 7:
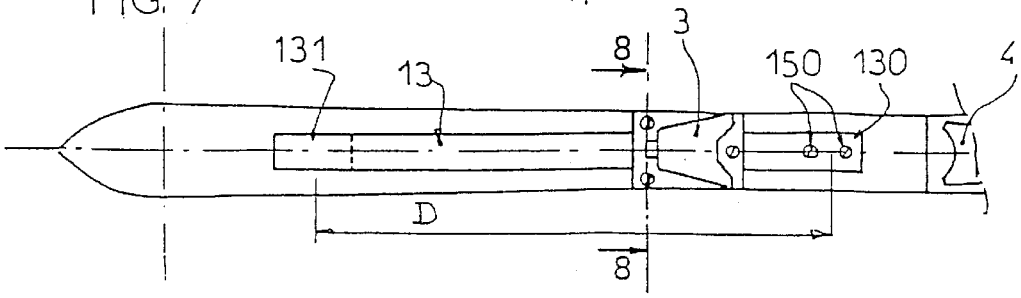

The material used may be elastic and have a density of between 10 and 85 shores A, or a viscoelastic material having a modulus of elasticity of from 15 to 160 megapascals, a hardness of from 50 to 95 shores A, and a damping value of from 0.13 to 0.72. Of course, these data are merely examples for a temperature of 20 degrees and a frequency of 15 Herz. The mounting of the interface 18 on the strip 13 and on the upper surface of the ski is made either of a duroplastic polyester, vinylester, or polyurethane epoxy resin of a thermoplastic film or any other means. Of course, the rear end 130 of the strip can be attached individually and independently of the stop 3, as illustrated in FIGS. 6 and 7. In FIG. 6, the strip is attached in front of the stop, while in FIG. 7 is attached behind the stop. In this case, the strip passes freely beneath the base plate 14 of the stop (see FIG. 8). To this end, the lower surface of the base plate comprises a hollowed-out section 140 whose dimensions are greater than those of the strip 13, so as to provide for the passage and free movement of the latter. The strip is thus attached directly to the ski using screws 150 in the area between the front binding 3 and the rear binding 4.

The flexible strip 13 can also be glued or welded to the upper surface 10 of the ski 1.

Figures 9, 9A, 10, 10A:
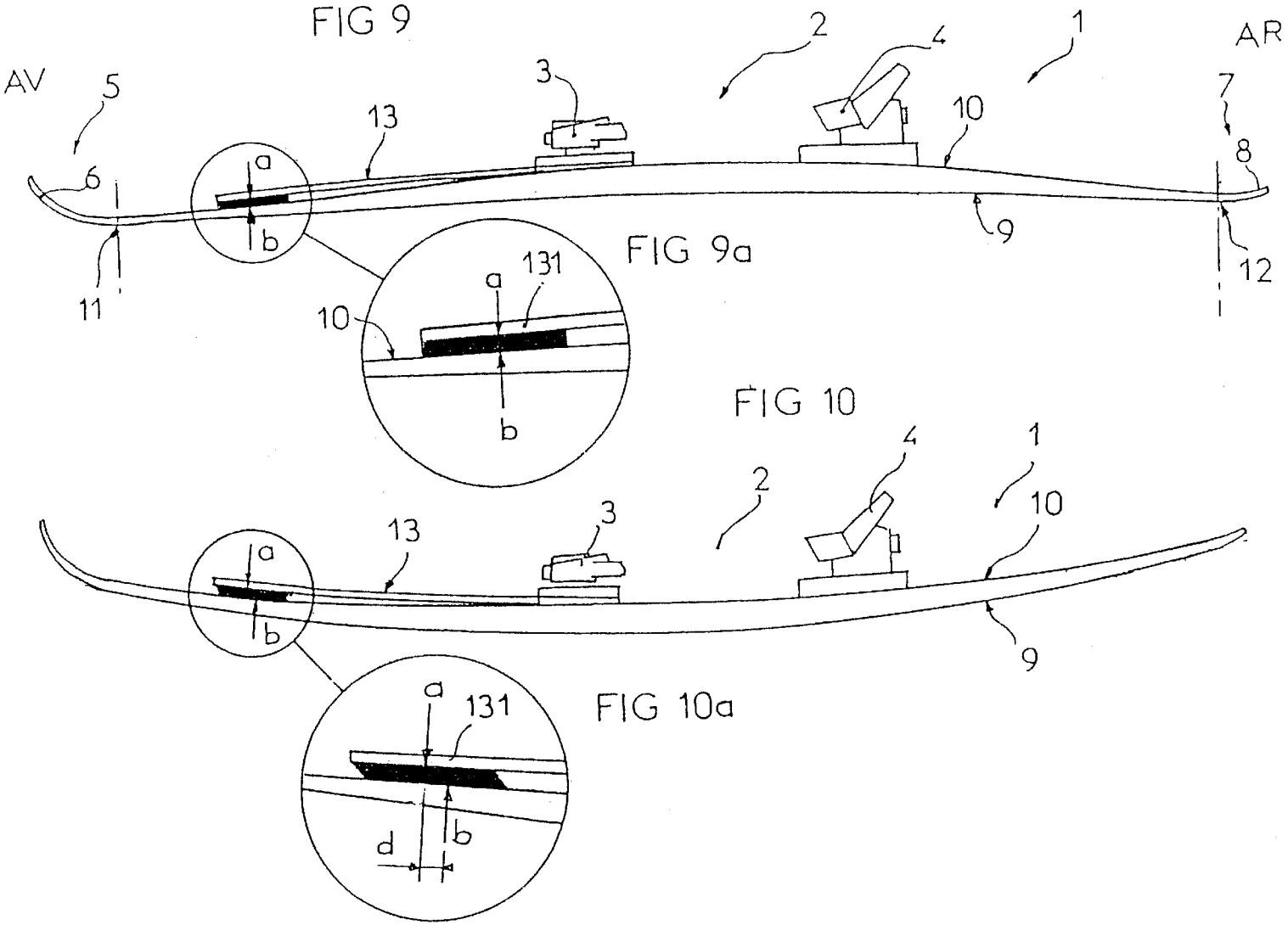
FIGS. 9, 9*a*, 10, and 10*a* are side views illustrating the operation of the device.

FIGS. 9, 9*a*, 10, and 10*a* illustrate diagrammatically the operation of the vibration-damping device. FIG. 9 represents the ski in the resting state and FIG. 10, the ski in the flexed position. At rest, point a on the front end 131 of the flexible strip corresponds to point b on the upper surface 10 of the ski. During flexion (FIG. 10), it is observed that relative longitudinal shifting d occurs between points a and b. During this shifting motion, the layer of flexible material is sheared, thus damping the vibrations. The choice of the material and dimensions of the interface determine the vibration-damping conditions.

Figure 11:
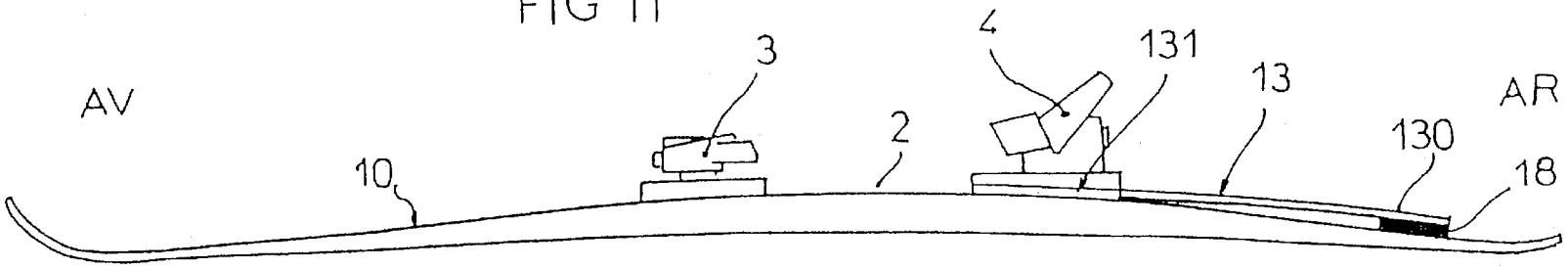
FIGS. 11 and 12, 13 and 14, 15 and 16, 17 and 18, 19 and 20, and 21 and 22 are views analogous to FIGS. 1 and 2, illustrating other embodiments.
Figure 12:
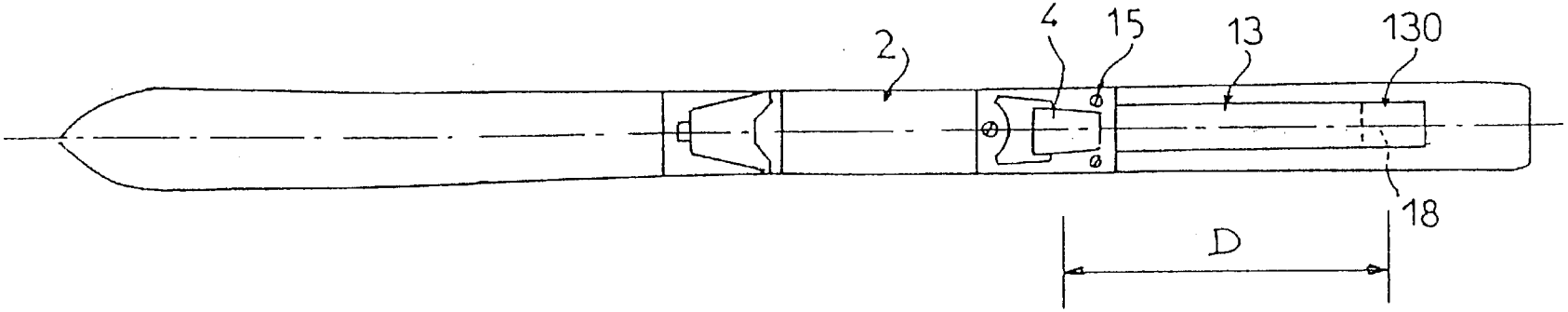

Of course, the vibration-damping device may be positioned at the rear of the ski, as illustrated in FIGS. 11 and 12. According to this variant, the front end 131 of the flexible strip 13 is then fastened rigidly to the ski, and the strip extends rearward. The rear end 130 of the strip is fastened to the ski using damping means 17 constituted, as before, by an interface 18 made of a flexible material.

Figures 13, 14:
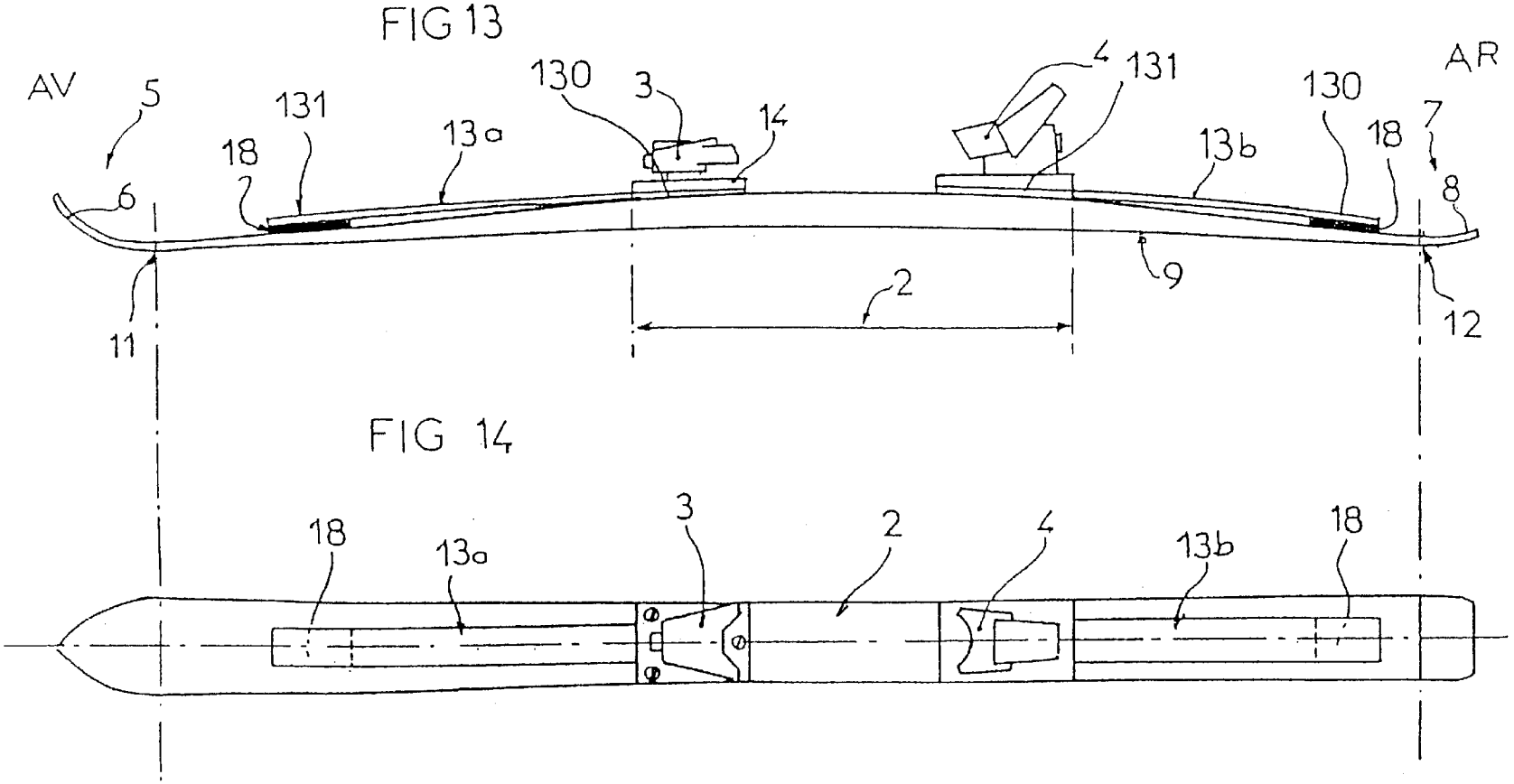

The ski may obviously comprise both a front flexible strip 13*a* and a rear flexible strip 13*b*, as illustrated in FIGS. 13 and 14.

Figure 15:
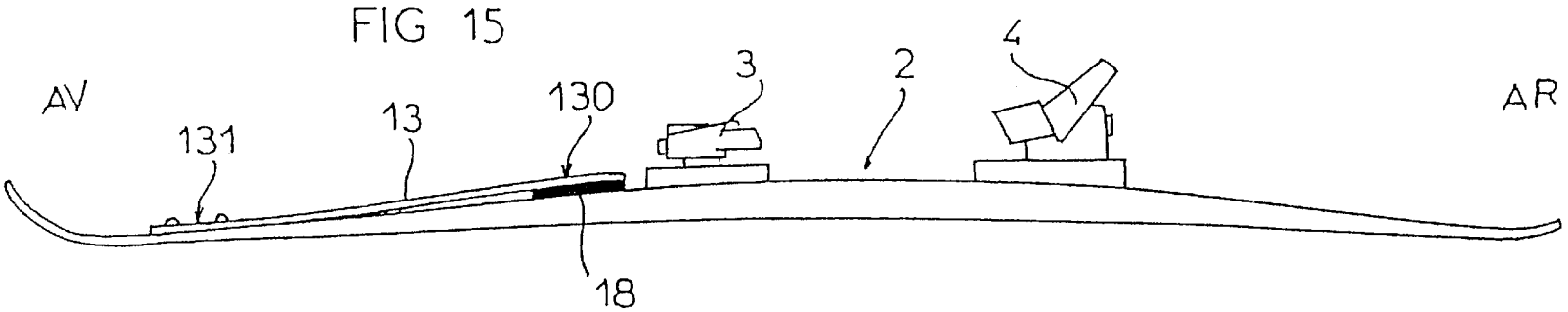
Figure 16:
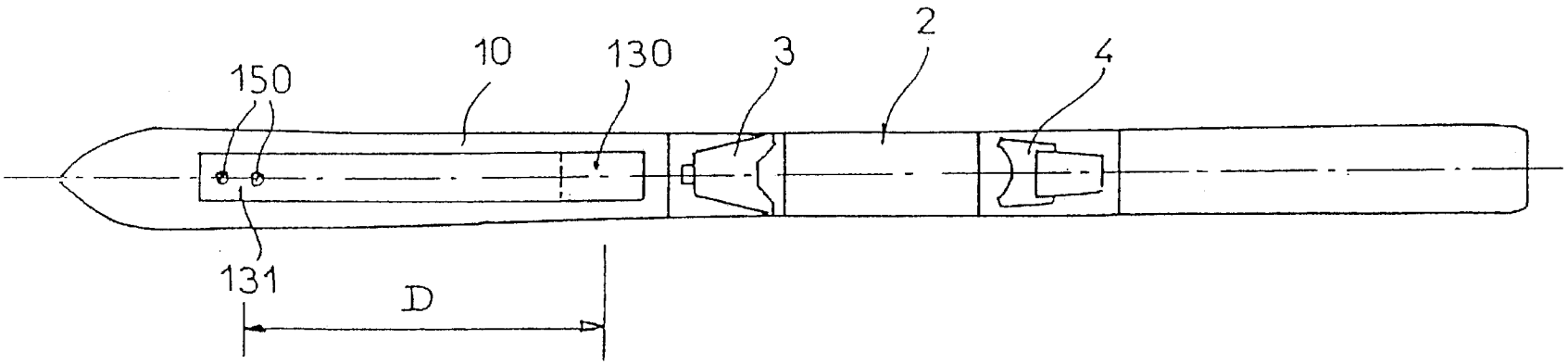

FIGS. 15 and 16 illustrate another embodiment according to which the front end 131 of the flexible strip 13 is fastened to the front part of the ski using screws 150. The strip 13 then extends rearward and its rear extremity 130 is attached to the ski, and, more specifically, to its upper surface 10, using damping means 17 which are identical to those described above, i.e., by means of a glued interface 18 made of a flexible material.

Figure 17:
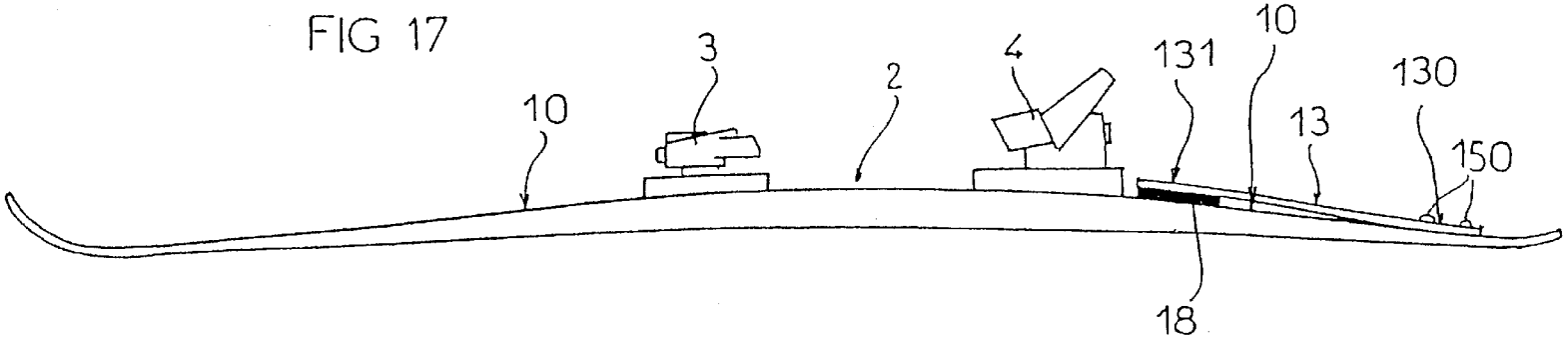
Figure 18:
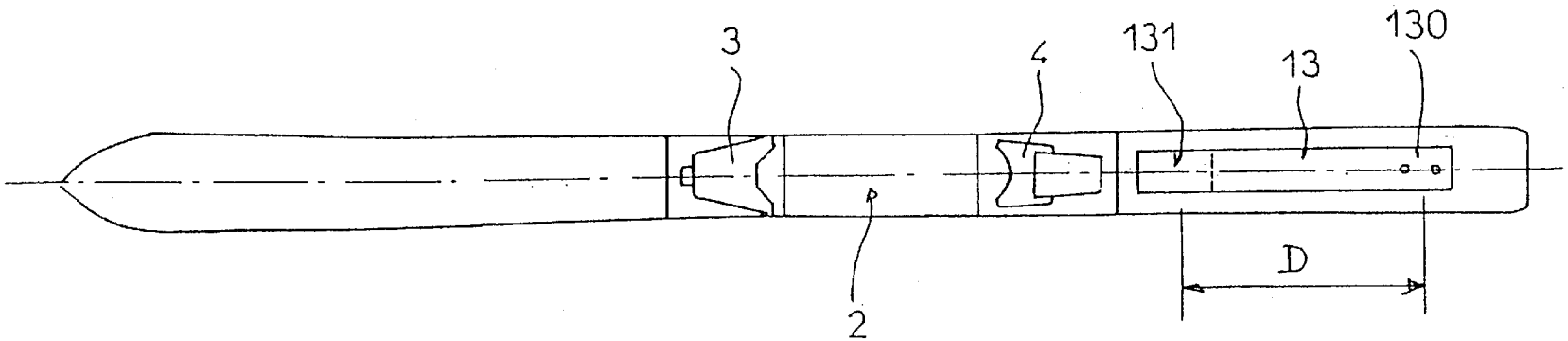

FIGS. 17 and 18 illustrate another variant according to which the strip 13 is attached to the rear of the ski using screws 150 and extends forward in order to be fastened to the ski by an interface 18 in an area located behind the heel piece.

It is obvious that, in the embodiments in FIGS. 15 to 18, the flexible strips may have a greater or lesser length.

Figure 19:
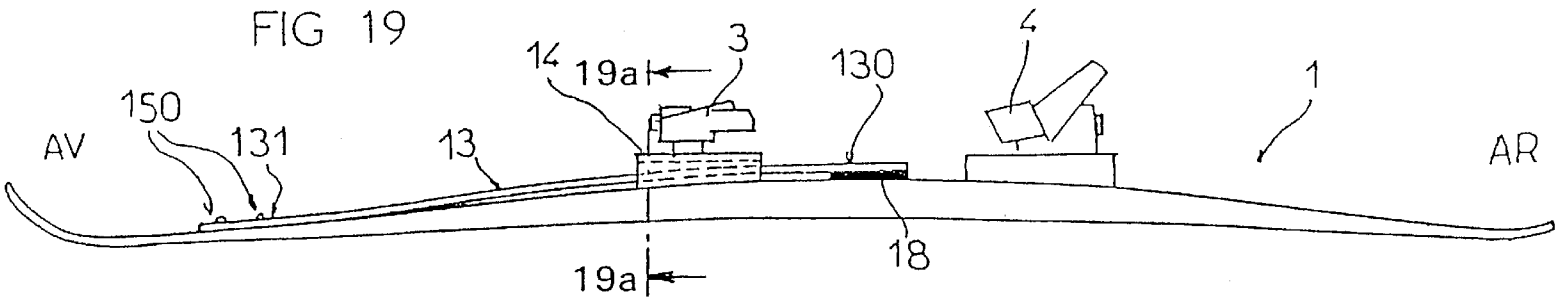
Figure 20:
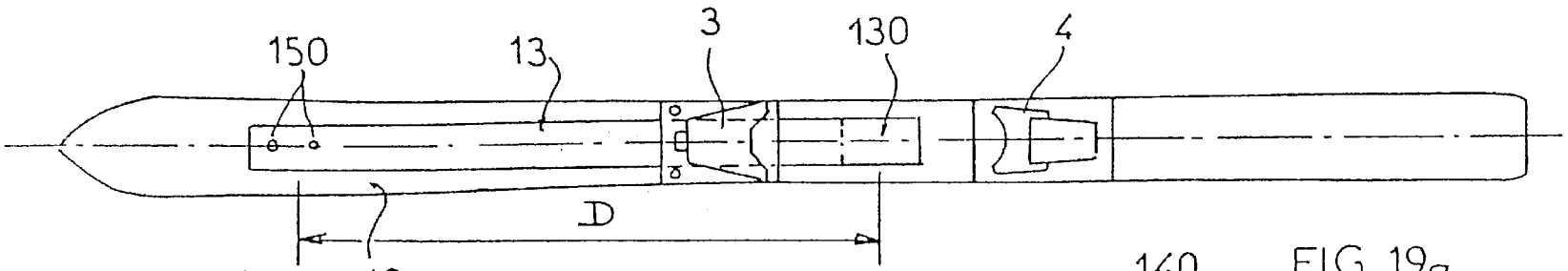
Figure 19A:
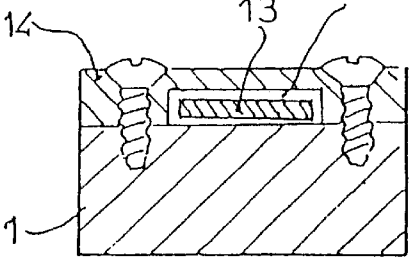
FIG. 19*a* is a transverse cross-section along line 19*a*—19*a* in FIG. 19.
Figure 21:
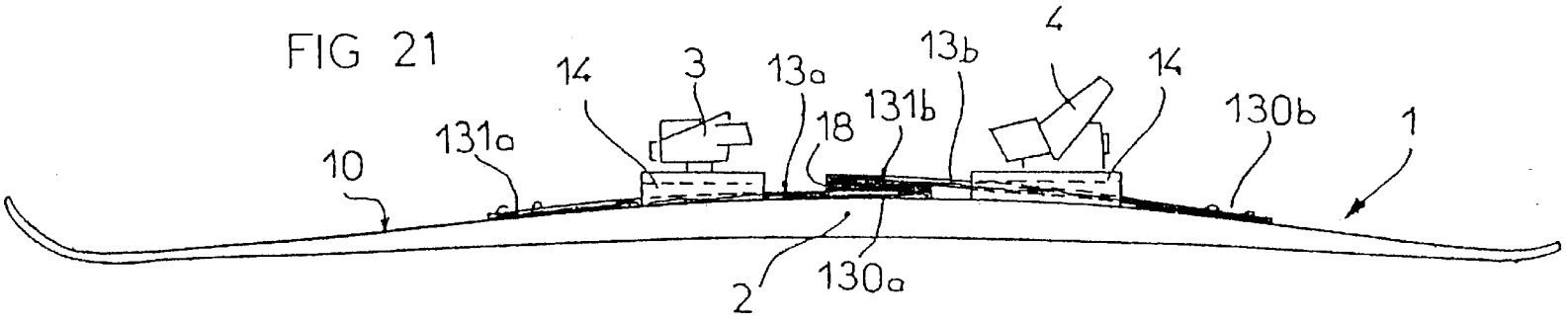
Figure 22:
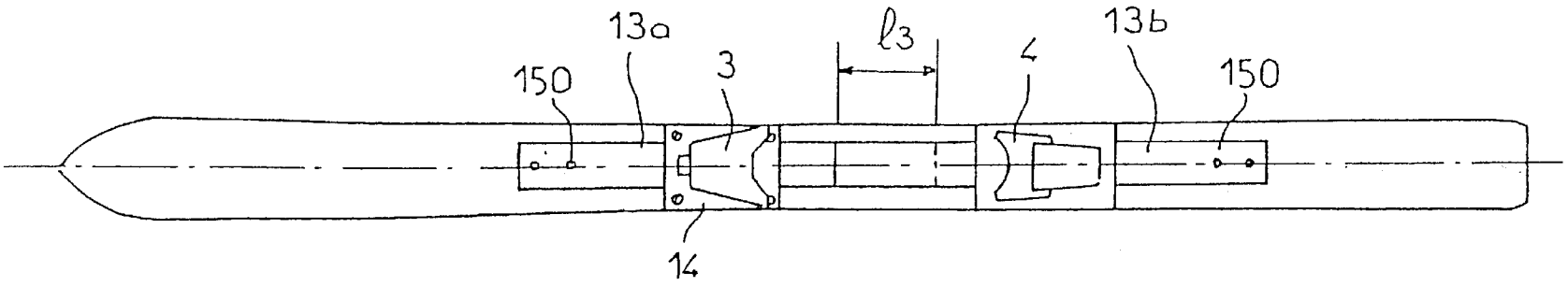

In this way, the strip 13 in FIG. 19 is freely engaged beneath the stop 3 so as to extend beyond the latter, in order to be elastically attached to the ski. To this end, the base plate 14 comprises a hollowed-out section 140 whose dimensions allow the penetration and free movement of the flexible strip 13.

FIGS. 21 to 24 represent a variant according to which the longitudinal effects caused by ski flexion are multiplied. For this purpose, the ski comprises two flexible strips 13*a*, 13*b*: i.e., a first front flexible strip 13*a* and a second rear flexible strip 13*b*. The front end 131*a* of the front flexible strip 13*a* is attached to the ski in front of the stop 3 using screws 150 and it extends rearward while passing freely beneath the stop 3. Similarly, the rear extremity 130*b* of the rear flexible strip 13*b* is attached to the ski behind the heel piece 4, and the flexible strip extends forward, passing freely beneath the heel piece 4 until it reaches the central area 2 between the two bindings 3, 4. It may be observed that the two ends overlap. The rear end 130*a* of the first strip 13*a* is engaged beneath the front end 131*b* of the second strip 13*b*, overlapping occurs over a length $l_3$.

In this variant, the vibration-damping means are constituted by an interface 18 formed by a layer of a flexible or viscoelastic material, as described above. However, this interface is positioned not on the ski, but between the two strips in the area in which they overlap. Thus the rear end 130*a* of the first strip 13*a* and the front end 131*b* of the second strip 13*b* are not attached in any way to the ski.

Figure 23:
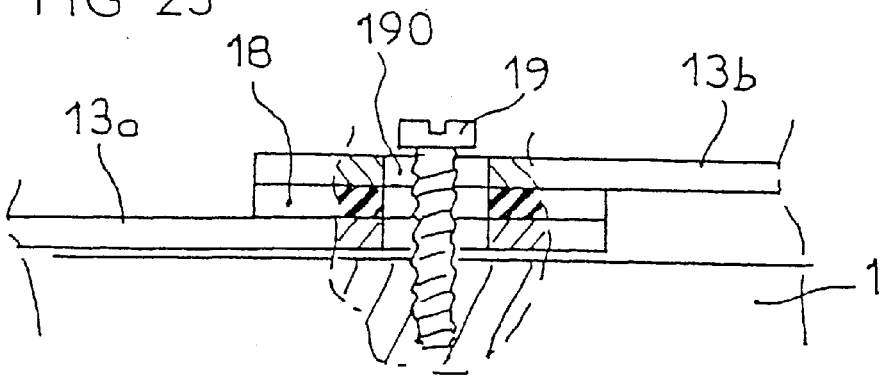
FIGS. 23 and 24 are enlarged partial representations illustrating a side view (FIG. 23) and a top view (FIG. 24) of an improvement.
Figure 24:
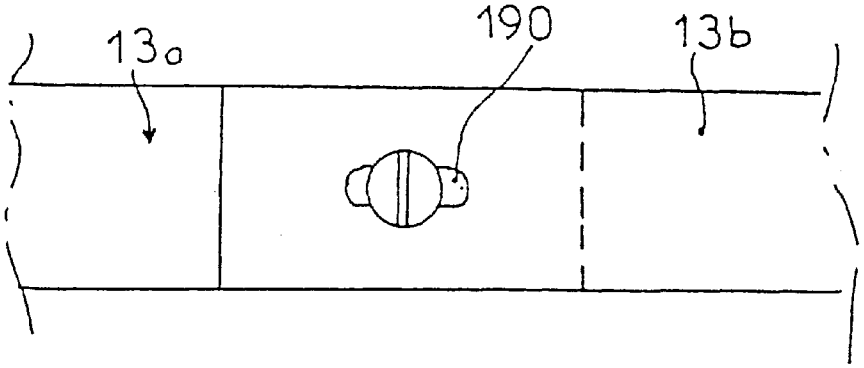

To prevent any possible raising of the ends 130*a* and 131*b* of the flexible strips 13*a* and 13*b*, a vertical position-maintenance device may be provided, such as a screw 19 housed in an oblong hole 190 in the stack formed by the two ends 130*a* and 131*b* and by the damping layer, as illustrated in FIGS. 23 and 24. Vertical position maintenance could also be implemented by using an inverted U-shaped stirrup or any other means.

Figure 25:
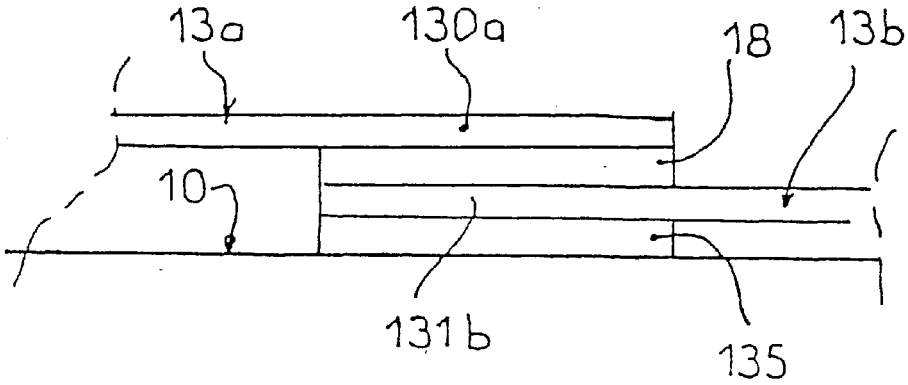
FIG. 25 is a side view of another detail of a variant.

Another variant is shown in FIG. 25, where a second damping layer 135 is glued to the upper surface of the ski 10, beneath the rear end 130*a* of the first strip 13*a*.

In the various embodiments proposed in FIGS. 1 to 25, the vibration-damping device is installed to the outside of the actual structure of the ski. However, incorporation of this device within the ski structure, as illustrated diagrammatically in FIGS. 26 and 27, would obviously remain within the scope of the invention.

The skis are most often constituted by a core 101 covered by one or several upper reinforcement layers 102, or even lower reinforcement layers 103. The top of the ski is generally covered with a decorative layer 104, while the bottom comprises a polyethylene sliding layer 105.

Figure 26:
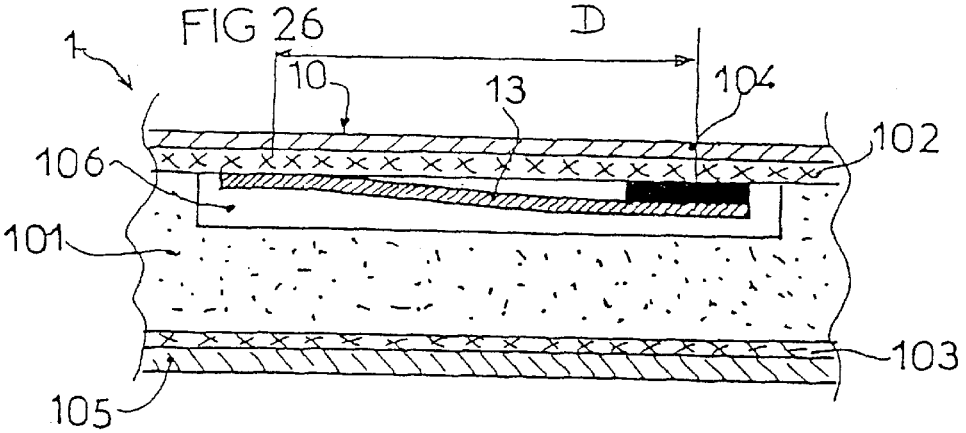
FIGS. 26 and 27 are a top view (FIG. 27) and a longitudinal cross-section along line 26—26 (FIG. 26) of another embodiment.
Figure 27:
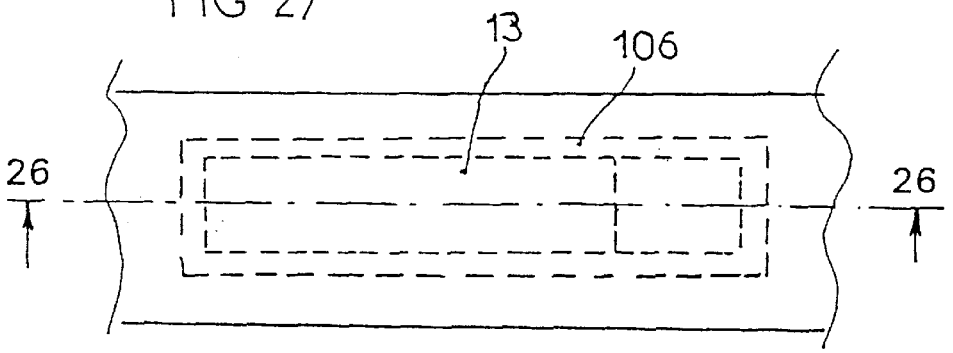

In the example shown in FIGS. 26 and 27, the flexible strip 13 is attached beneath the upper reinforcement layer 102 and occupies a housing 106 in the core. It is obvious that one would remain within the scope of the invention, regardless of the position of the vibration-damping device. In fact, the flexible strip could be positioned between the core 101 and the lower reinforcement piece 103, or even between the upper reinforcement piece 102 and the surface layer 104.

It should be indicated that the flexible strip previously illustrated and described has a uniform transverse section, but that this section could be quite different. Thus, the section of the strip may be variable in transverse cross-section. In fact, the width as well as the thickness may vary. The shape of the section, which, in the embodiments shown, is rectangular, could be trapezoidal and of variable length.

Figure 28:
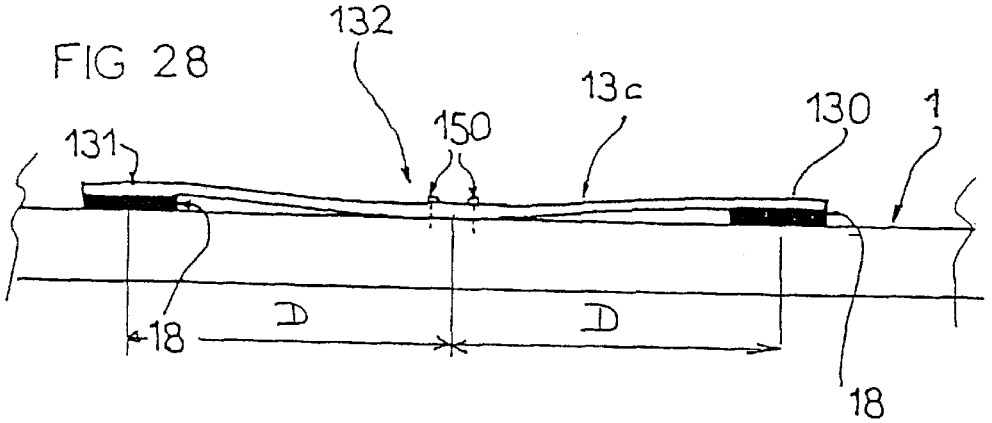
FIG. 28 is a side view of another embodiment.

FIG. 28 is a side view of another variant, according to which the vibration-damping device is formed from a strip 13c attached in its central part 132 and whose front and rear ends 131 and 130, respectively, are elastically connected to the ski 1.

Figure 29:
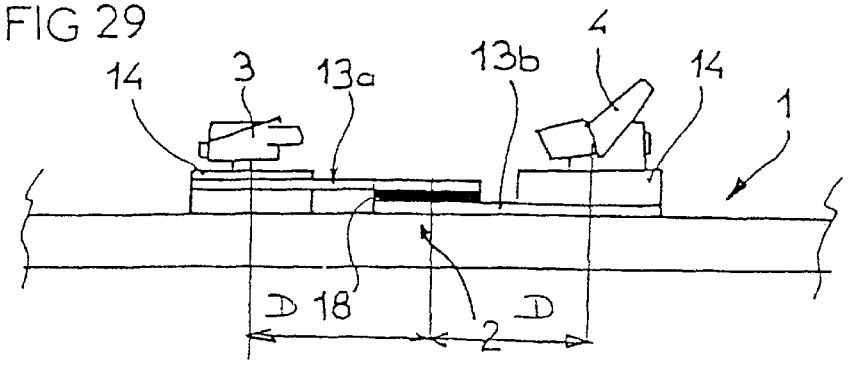
FIG. 29 is a side view illustrating another variant.

FIG. 29 illustrates a variant in which the strips 13*a* and 13*b* elastically connected to each other in the central area 2 of the ski, are attached by their ends by means of the corresponding ski bindings 3 and 4.

What is claimed is:

1. A ski equipped with a device intended to damp vibrations, said ski comprising an elongated beam having a stiffness, with a central portion for mounting bindings, said device comprising at least one flexion strip which flexes with said ski relative to bindings when mounted on said ski, said strip extending longitudinally and having two ends, one of said ends being connected to said ski by rigid attachment means, said flexion strip comprising at least one free end which is displaced longitudinally relative to the ski when the ski is biased in flexion, and being spaced longitudinally from said rigid attachment means, wherein said free end of said flexion strip is connected to the ski by separate shearing means which is sheared during longitudinal displacements, damping said longitudinal displacements of said free end, said shearing means being interposed vertically between said free end of said flexion strip and an upper surface of said ski.

2. The ski according to claim 1, wherein said rigid attachment means is located at the other end of said flexion strip (13*c*) remote from said free end.

3. The ski according to claim 1, wherein said flexion strip (13*c*) is made of aluminum.

4. Ski according to claim 1, wherein said flexion strip is positioned and attached to an upper surface of said ski.

5. Ski according to claim 4, wherein said flexible strip extends between a central zone in which bindings are mounted and a front point of contact of said ski.

6. Ski according to claim 4, wherein said flexible strip extends between a central zone in which bindings are mounted and a rear point of contact of said ski.

7. Ski according to claim 4, wherein said flexible strip extends both over a central area in which bindings are mounted and over an area located between said central area and a front point of contact of said ski.

8. Ski according to claim 4, wherein said flexible strip extends both over a central area in which bindings are mounted and over an area located between said central area and a rear point of contact of said ski.

9. Ski according to claim 5, wherein said flexible strip has a rear end rigidly attached to said ski and a front end fastened to said ski by means of a flexible damping connection piece.

10. Ski according to claim 5, wherein said flexible strip has a front end rigidly fastened to said ski and a rear end fastened to said ski by means of a flexible damping connection piece.

11. Ski according to claim 9, comprising two flexible strips, including a front flexible strip having a front end fastened to the front of said ski and extending rearwardly, and a rear flexible strip having a rear end attached to the rear of said ski and extending forwardly, said rear end of said front flexible strip and said front end of said rear flexible strip overlapping in a central area of said ski and being connected to each other by an elastic connection piece.

12. A ski equipped with a device intended to damp vibrations, said ski comprising an elongated beam having a stiffness, with a central portion for mounting bindings, said device comprising at least one flexion strip which flexes with said ski relative to bindings when mounted on said ski, said strip extending longitudinally and having two ends, one of said ends being connected to said ski by rigid attachment means, said flexion strip comprising at least one free end which is displaced longitudinally relative to the ski when the ski is biased in flexion, and being spaced longitudinally from said rigid attachment means, wherein said free end of said flexion strip is connected to the ski by a layer of flexible material which is sheared during longitudinal displacements, damping said longitudinal displacements of said free end, said layer being interposed vertically between said free end of said flexion strip and an upper surface of said ski.

* * * * *